US009051090B2

(12) United States Patent
Antier et al.

(10) Patent No.: US 9,051,090 B2
(45) Date of Patent: Jun. 9, 2015

(54) STOPPER DEVICE FOR THE NECK OF A CONTAINER

(75) Inventors: Grégory Antier, Trévoux (FR); Michel Luzzato, Ecully (FR)

(73) Assignee: Tetra Laval Holdings & Finance S.A., Pully (CH)

( * ) Notice: Subject to any disclaimer, the term of this patent is extended or adjusted under 35 U.S.C. 154(b) by 0 days.

(21) Appl. No.: 13/824,274

(22) PCT Filed: Jun. 22, 2012

(86) PCT No.: PCT/EP2012/062072

§ 371 (c)(1),
(2), (4) Date: May 17, 2013

(87) PCT Pub. No.: WO2012/175663

PCT Pub. Date: Dec. 27, 2012

(65) Prior Publication Data

US 2014/0097150 A1 Apr. 10, 2014

(30) Foreign Application Priority Data

Jun. 24, 2011 (FR) ..... 11 55608

(51) Int. Cl.
*B65D 41/00* (2006.01)
*B65D 43/02* (2006.01)
*B65D 47/08* (2006.01)

(52) U.S. Cl.
CPC ..... *B65D 43/0235* (2013.01); *B65D 47/08* (2013.01); *B65D 2101/0038* (2013.01); *B65D 2101/0046* (2013.01)

(58) Field of Classification Search
CPC ..... B65D 41/0414; B65D 47/08; B65D 2101/0046
USPC ..... 220/257, 258; 215/354
See application file for complete search history.

(56) References Cited

U.S. PATENT DOCUMENTS

| | | | | |
|---|---|---|---|---|
| 5,505,325 | A * | 4/1996 | Thompson et al. | 220/257.1 |
| 6,269,986 | B1 * | 8/2001 | Gross | 222/541.5 |
| 2005/0173370 | A1 * | 8/2005 | Odet et al. | 215/347 |

FOREIGN PATENT DOCUMENTS

| | | | |
|---|---|---|---|
| FR | 2820120 | A1 | 8/2002 |
| WO | WO 93/00271 | A1 | 1/1993 |
| WO | WO 2008/068416 | A2 | 8/2002 |
| WO | WO 2010/128288 | A1 | 11/2010 |

OTHER PUBLICATIONS

International Search Report of PCT/EP2012/062072, Aug. 8, 2012, 4 pages.

* cited by examiner

*Primary Examiner* — Anthony Stashick
*Assistant Examiner* — Raven Collins
(74) *Attorney, Agent, or Firm* — Finnegan, Henderson, Farabow, Garrett & Dunner, L.L.P.

(57) ABSTRACT

A stopper device includes a base adapted to be fastened to a neck of a container, and a cap movable relative to the base between closed and open positions. A strand in an unaltered configuration extends along a periphery of the cap. First and second longitudinal ends of the strand are connected to the cap frangibly and non-frangibly, respectively. A hook protrudes toward an outside of the base, and when the strand is in the unaltered configuration, the hook retains a running portion of the strand, blocking movement of the cap from the closed to the open position. The first end of the strand includes a tab for detaching the first end by breaking the frangible connection and moving the running portion toward an outside of the cap until the cap may freely move from the closed to the open position without the running portion being retained by the hook.

15 Claims, 10 Drawing Sheets

STOPPER DEVICE FOR THE NECK OF A CONTAINER

CROSS-REFERENCE TO RELATED APPLICATIONS

This application is a US National Phase of PCT/EP2012/062072 filed on Jun. 22, 2012, which claims the benefit of FR 1155608 filed on Jun. 24, 2011, which is incorporated herein by reference.

TECHNICAL FIELD

The present invention relates to a stopper device for the neck of a container.

BACKGROUND

In the field of liquid packaging, it is very common to equip the neck, whether threaded or unthreaded, of a container with a stopper device, generally made from molded plastic, that includes both a globally tubular base, provided to be immobilized around the neck, and a removable cap, in particular pivotably supported by the base. This type of device, commonly designated using the expression "sport-cap," is used to allow the user to drink directly from the neck of the container, after having freed the cap in a position far enough from the base to allow the flow through that base of liquid contained in the container.

Before the first use of this type of stopper device, i.e. before the first time the cap is opened relative to the base, the cap and the base are connected to one another by tamper-evident means that may be at least partially broken the first time the device is opened. The tamper-evident means thus in principle provide the user with a visual indication as to whether the device he is manipulating has already been opened. This visual indication is blatant when at least part of the tamper-evident means has been completely separated from the rest of the device. However, in that case, that separated portion, which is generally small, poses a safety problem, since it risks being ingested or inhaled, as well as an environmental problem, since the user tends to get rid of it without taking the precaution of placing it in a wastebasket.

To avoid these problems, known embodiments of tamper-evident means consist of having at least part of said means be, after local rupture of one or more limited frangible zones, deformed enough relative to the rest of the device, under the action of the cap moved during opening or under the direct action of the user so as to free the cap to be opened, to provide a visual indication of first opening, the aforementioned portion of the tamper-evident means remaining permanently connected to the device. However, in that case, the visibility of the first opening indication is often limited, which generally requires the user to meticulously inspect the device to determine whether it has been opened a first time. Thus, WO-A-2010/128 888, on which the preamble of claim 1 is based, proposes locking the movable cap using a protruding hook integral with the base: in order to release the cap, the portion thereof engaged with the hook must be deformed enough to release the hook, which requires that the user first move a peripheral strand away which, over the entire length thereof, is initially frangibly connected to the cap and the hook.

BRIEF SUMMARY

The aim of the present invention is to improve the tamper-evident means of stopper devices with pivoting caps or, more generally, a movable cap, so that these means present better visibility while remaining effective.

To that end, the invention relates to a stopper device for the neck of a container as defined in claim 1.

The idea at the base of the invention is to integrate the tamper-evident means into a "two-step actuating" system to open the cap for the first time. In this way, according to the invention, the cooperation between a hook, secured to the base, and a strand that is not yet altered, secured to the cap, initially blocks the movement of the cap from the closed position to the open position thereof, which prevents the user from opening the device. The user is therefore naturally forced to try to eliminate that blockage, by acting beforehand on the strand: a manual stressing tab, provided at a first end of said strand, can then be driven by the user so as to move it away from the rest of the cap, while driving it globally radially outward. In so doing, the first end of the strand is jointly driven with said tab, which breaks the frangible connection provided between said first end and the cap. In the same motion, the user continues to release the rest of the strand, causing the plastic deformation of the connection between the second end of the strand and the cap, until the strand has been moved sufficiently outward so that its running portion, which extends globally transversely protruding toward the outside relative to the cap, no longer interferes with the hook integral with the base: the user can then freely move the cap toward the open position thereof, without the running portion of the strand abutting again against the hook. It is less understood that, after the user has released the strand, in particular to rotate the cap, said strand preserves its altered configuration, i.e. moved transversely toward the outside of the rest of the device, due to the plastic deformation the connection between the second end of the strand and the cap has undergone. This altered configuration provides the user with a clear, unambiguous and easily observable physical indication, even if the cap has ultimately never been moved to its open position, or even when, subsequently, the cap is returned to the open position thereof, or from an intermediate position, to the closed position thereof, the strand being structurally incapable of returning to its unaltered configuration.

Advantageous additional features of the stopper device according to the invention are specified in claims 2 to 15.

BRIEF DESCRIPTION OF THE DRAWINGS

The invention will be better understood upon reading the following description, provided solely as an example and done in reference to the drawings, in which.

DETAILED DESCRIPTION

Figure 1:
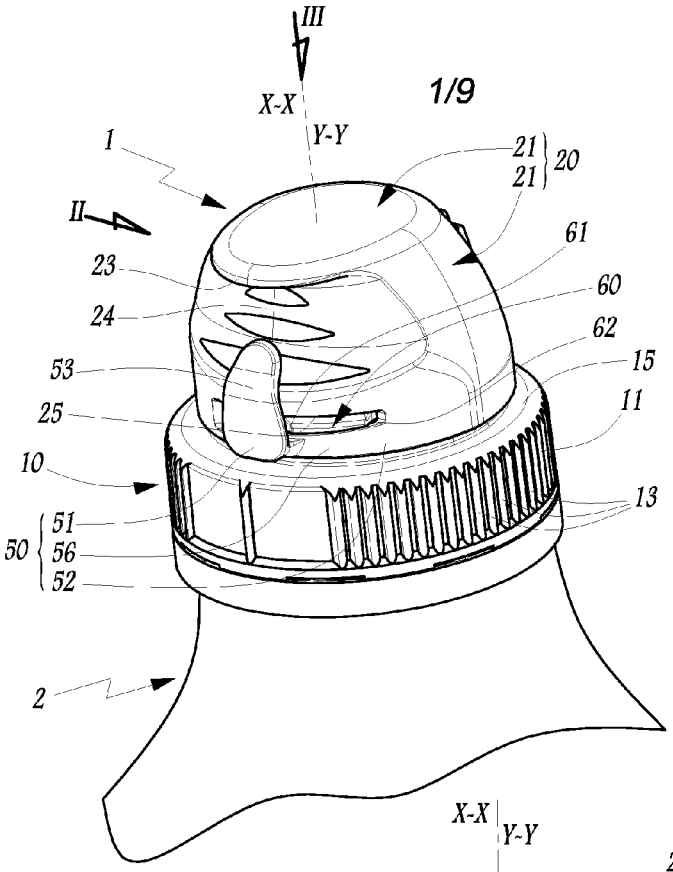
FIG. 1 is a perspective view of a stopper device according to the invention, assembled to the neck of a container and not yet having been opened for the first time.
Figure 12:
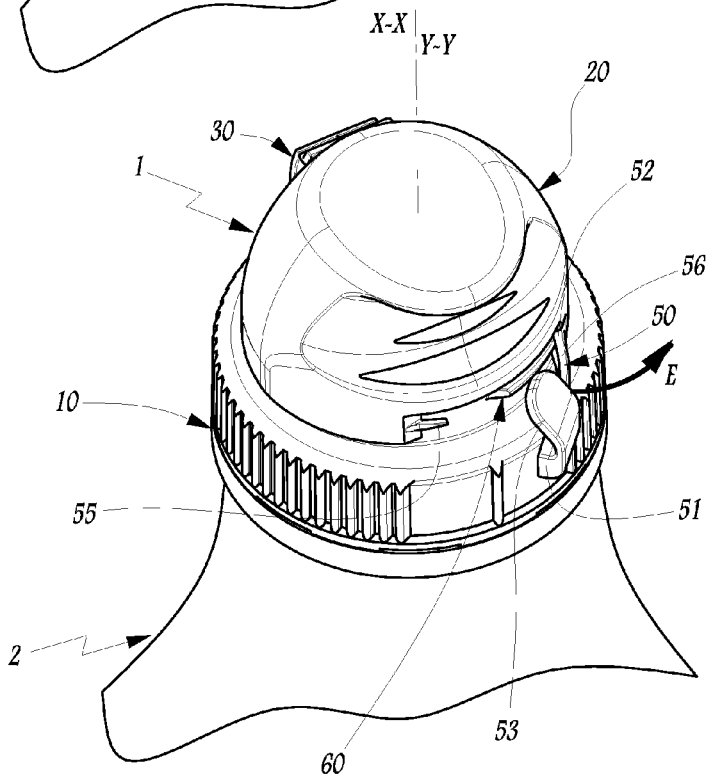
FIG. 12 is a perspective view similar to FIG. 1, from a different angle, showing an altered configuration of the tamper-evident means of the stopper device.

FIGS. 1 to 14 show a stopper device 1 for a neck of a container, such as a bottle.

In general, the neck 2 is made integral with the rest of the aforementioned container, in particular when the latter is a glass or plastic container, or adapted to be permanently secured on a wall of said container, at a through opening of said wall.

The neck of the container 2 has a tubular shape, the central longitudinal axis of which is referenced X-X.

For convenience, the rest of the description of the stopper device 1 is oriented relative to the axis X-X, considering that the terms "lower" and "bottom" describe a portion of the stopper device 1 oriented axially toward the main body of the container when the device 1 covers the neck 2 of said container and when the latter is resting on a horizontal plane, such as a table, with its neck oriented upward, as in FIGS. 1, 2, 4 and 10 to 13. Conversely, the terms "upper" and "top" correspond to an opposite axial direction.

The stopper device 1 comprises a base 10 having a globally tubular shape, centered on an axis which, when the device 1 equips the neck of the container 2, is combined with the axis X-X such that, for convenience, the axis of the base 10 is also referenced X-X in this document. As shown in FIGS. 1 to 6, the base 10 includes a tubular main body 11 with an essentially circular base centered on the axis X-X. This body 11 is adapted to be securely supported around the neck of the container 2, here by screwing: this body 11 is therefore provided with an inner thread 12 complementary to an outer thread 3 of the neck of the container 2, whereas the outer surface of the body 11 is advantageously provided with longitudinal ribs 13 facilitating gripping of the base 10 to screw the body 11 around the neck of the container.

Figure 4:
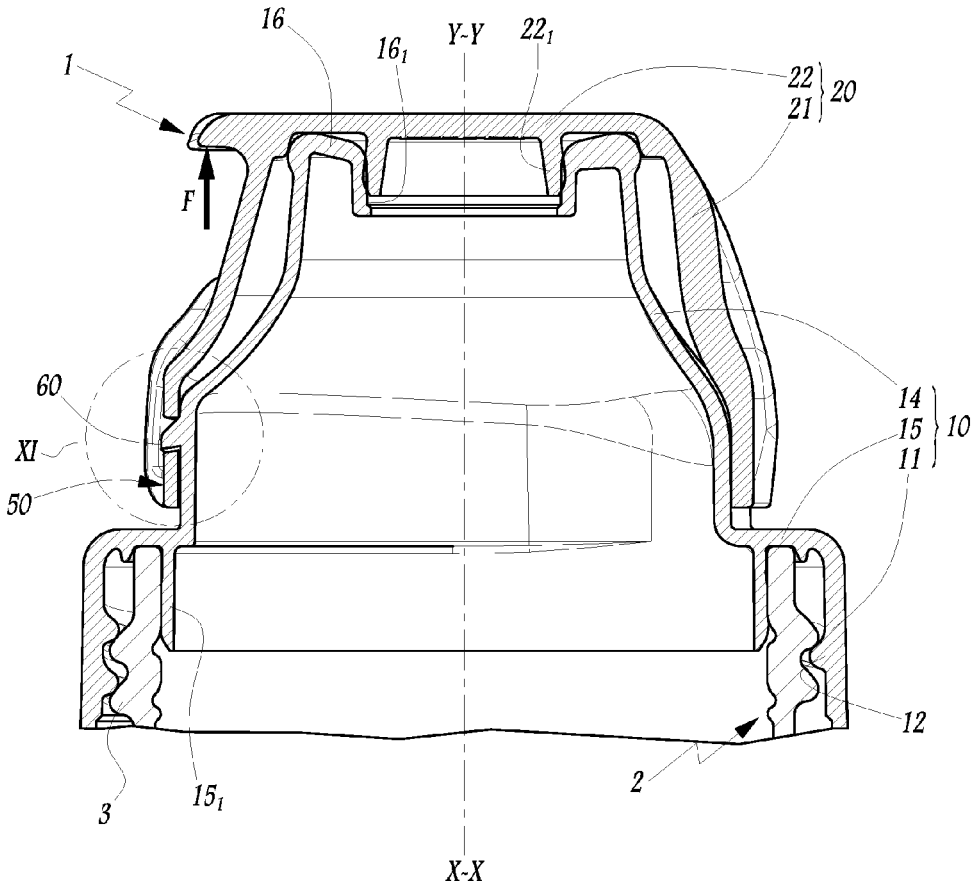
FIG. 4 is a longitudinal cross-section along line IV-IV of FIG. 3.
Figure 5:
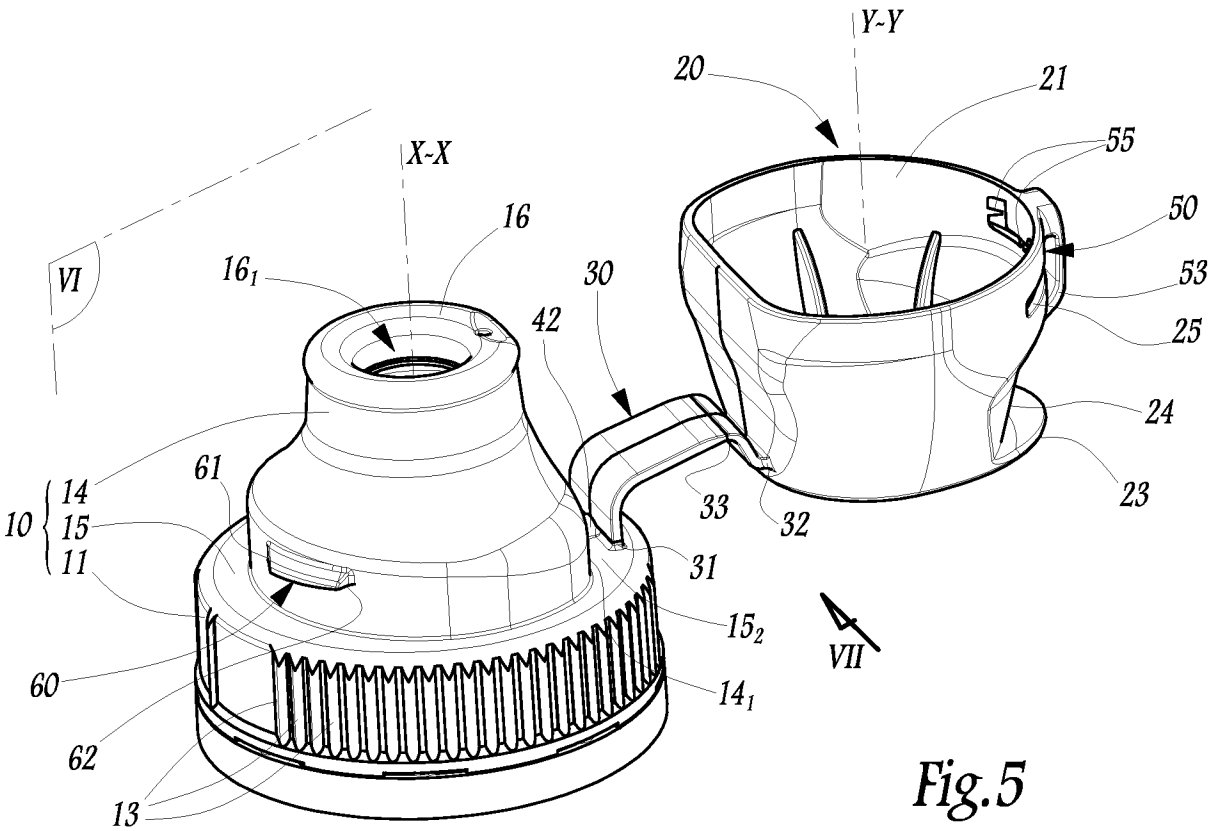
FIG. 5 is a perspective view of the stopper device of FIG. 1, showing that device not yet assembled to the neck of a container, in a manufacturing configuration, typically a configuration upon leaving the mold.
Figure 6:
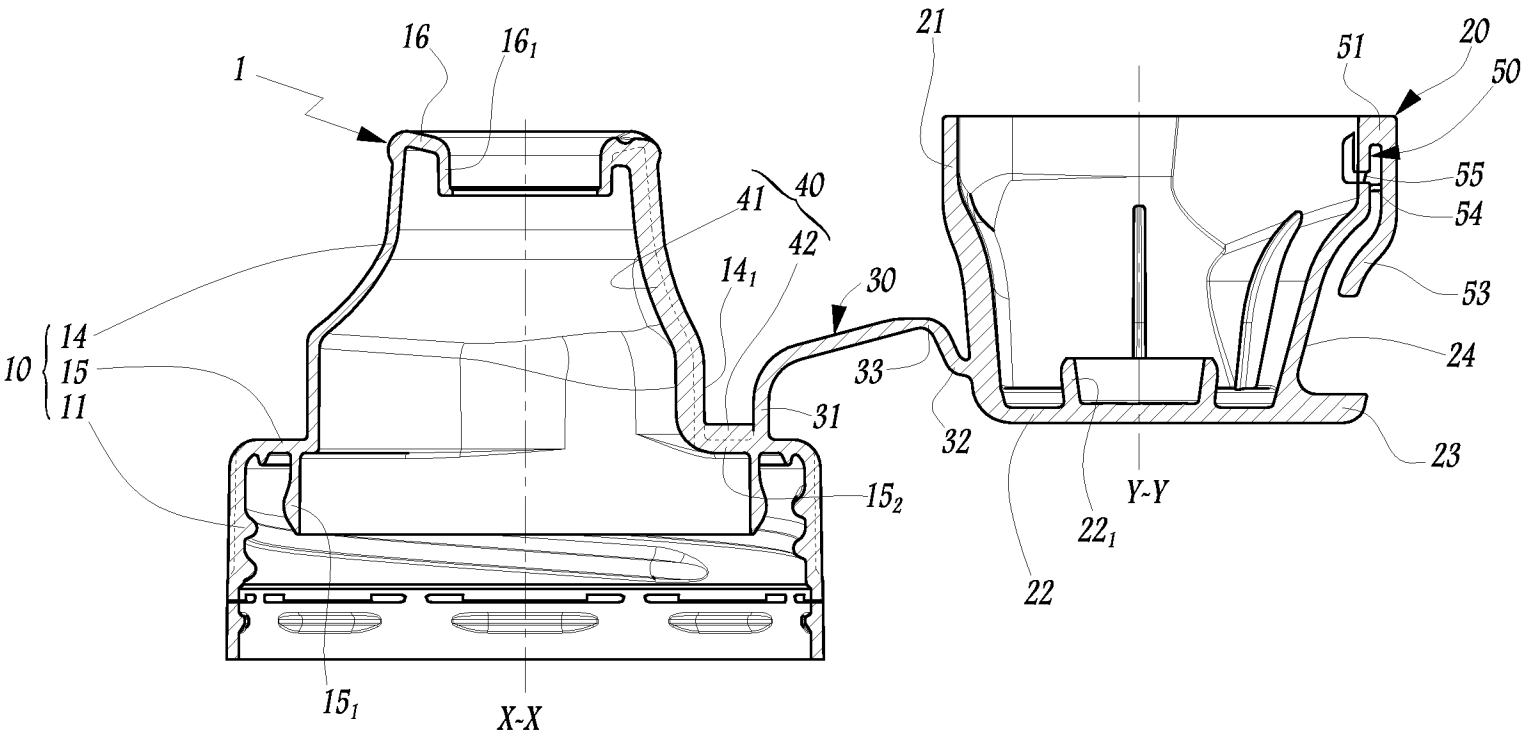
FIG. 6 is a cross-section in plane VI of FIG. 5.
Figure 7:
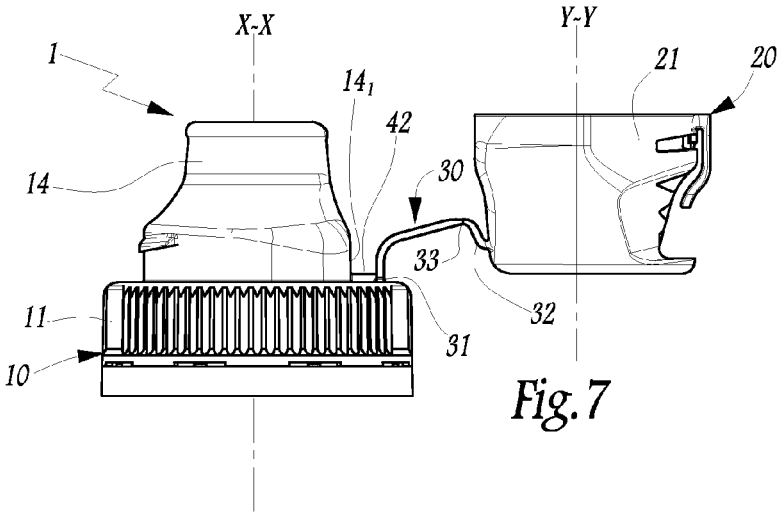
FIGS. 7 to 9 are elevation views along arrow VII of FIG. 5, respectively showing three successive steps of a prior initial closing of the stopper device.
Figure 8:
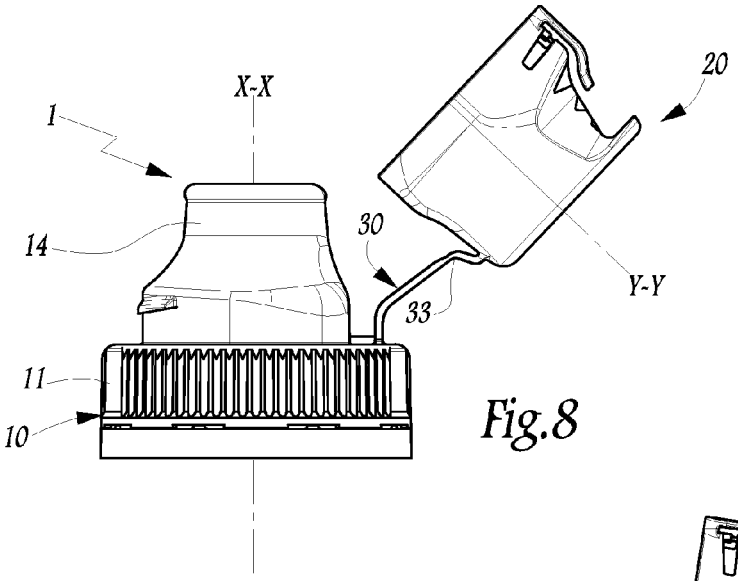
Figure 9:
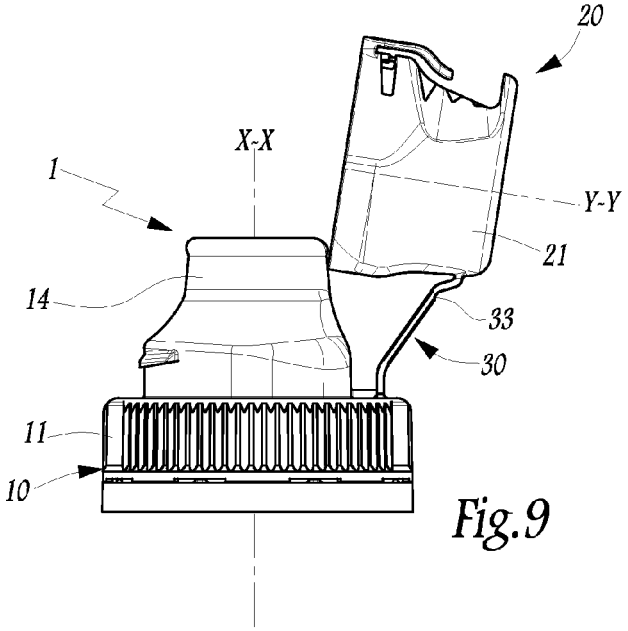

The base also comprises a nipple 14 having a globally tubular shape, centered on the axis X-X and narrowing upwardly. The lower portion of the nipple 14 is rigidly connected to the top portion of the body 11, here being made in a single piece, by a substantially horizontal annular wall 15, i.e. that fits substantially in a perpendicular plane X-X. The maximum outer transverse dimension of the nipple 14 being provided to be smaller than the maximum inner transverse dimension of the body 11, the annular wall 15 forms a transitional shoulder between the body 11 and the nipple 14, protruding radially from the lower portion of the nipple 14 and running over the entire outer periphery of said nipple, as shown in FIGS. 4 to 6. In other words, the annular wall 15 connects, over the entire periphery of the base 10, the inner surface of the body 11 to the outer surface of the nipple 14.

As one advantageous optional arrangement, the annular wall 15 is provided, on the lower surface thereof, with a sealing skirt $\mathbf{15}_1$ adapted to bear sealably against the inner surface of the neck of the container 2 when the base 10 is secured to the neck, as shown in FIG. 4.

At its upper end, the nipple 14 is partially closed by a substantially horizontal bottom wall 16, which delimits, in the central region thereof, a cylindrical opening $\mathbf{16}_1$ substantially centered on the axis X-X.

The stopper device 1 also comprises a cap 20, which, as shown in FIGS. 4 to 6, has a globally tubular shape centered on axis Y-Y. More specifically, the cap 20 includes a tubular main body 21, centered on the axis Y-Y and narrowing slightly toward one of the axial ends thereof, which is closed by a bottom wall 22 extending globally in a plane perpendicular to the axis Y-Y. This bottom wall 22 is provided, on the surface thereof oriented towards the inside of the body 21, with a sealing skirt $\mathbf{22}_1$ that is sized to be inserted inside the opening $\mathbf{16}_1$ so as to close said opening substantially sealably. The cap 20 is thus capable of plugging the neck of the container 2 by closing the base 10.

Figure 13:
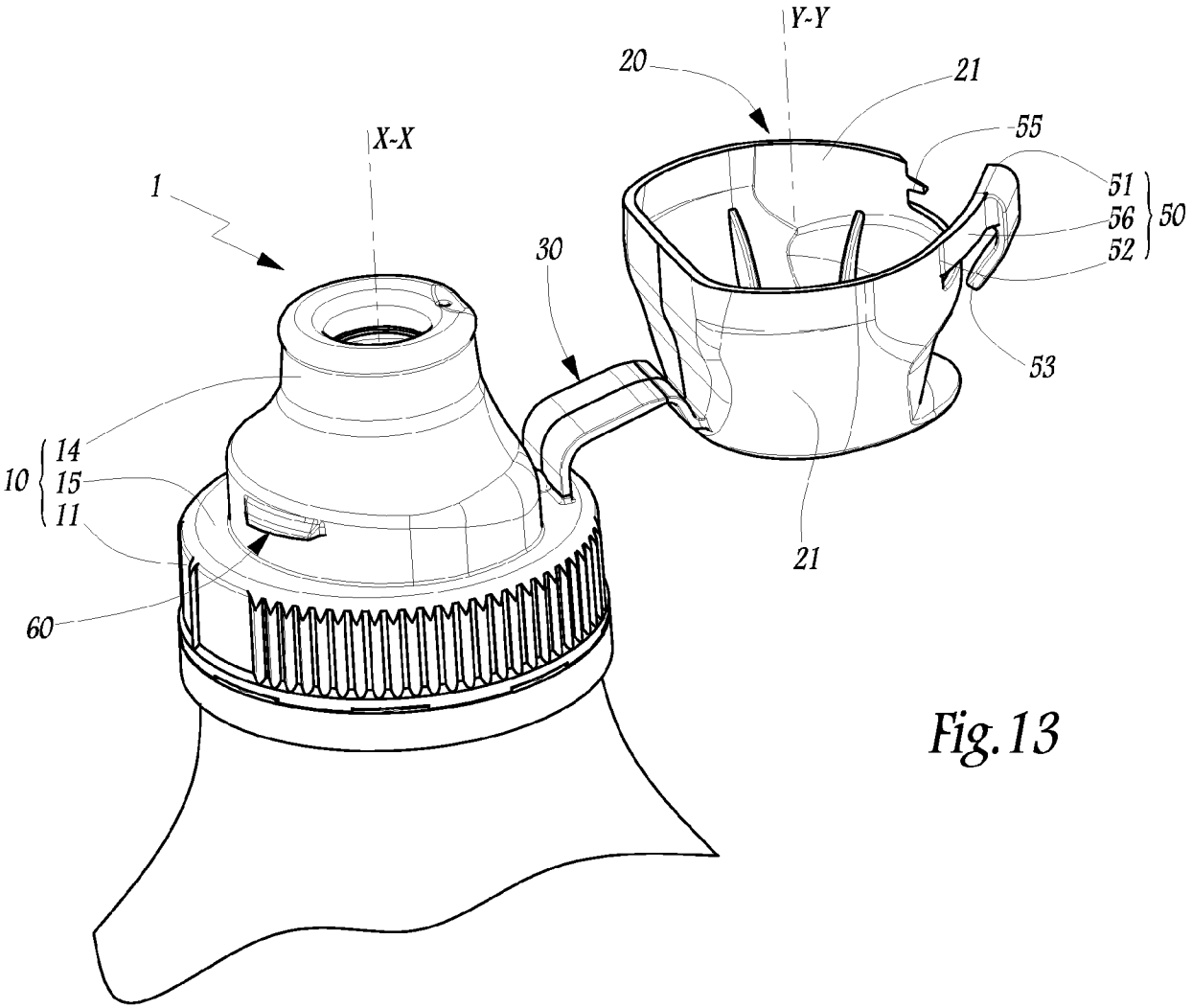
FIG. 13 is a view similar to FIG. 1, showing the stopper device after the first time it is opened.

The cap 20 is movable relative to the base 10, while being movable between a closed position, shown in FIGS. 1 to 4 and in which the body 21 covers the nipple 14, with the skirt $\mathbf{22}_1$ covering the opening $\mathbf{16}_1$, the axes X-X and Y-Y then being substantially combined, and an open position, which is shown in FIGS. 5, 6 and 13 and in which the cap 20 is sufficiently freed from the nipple 14 for the opening $\mathbf{16}_1$ to communicate freely with the outside and, when the base 10 is assembled to the neck of the container 2, a user can pour the liquid contained in the container body through the opening $\mathbf{16}_1$, via the neck 2, in particular by placing his mouth directly on the nipple 14.

Figure 2:
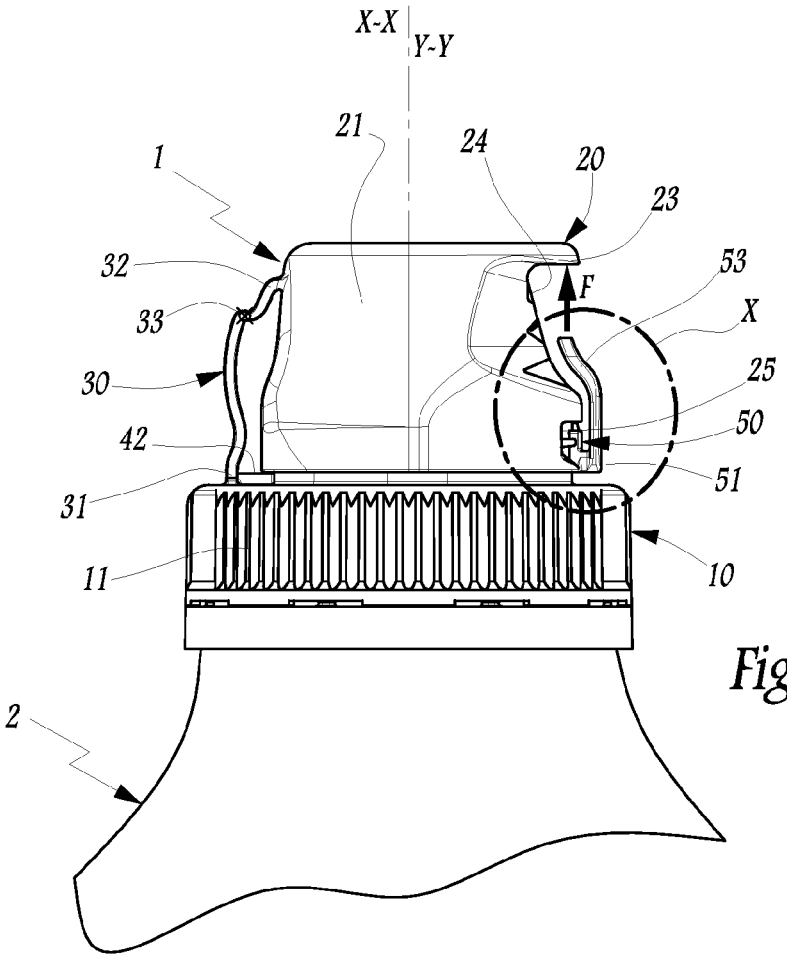
FIGS. 2 and 3 are elevation views along arrows II and III, respectively, of FIG. 1.
Figure 3:
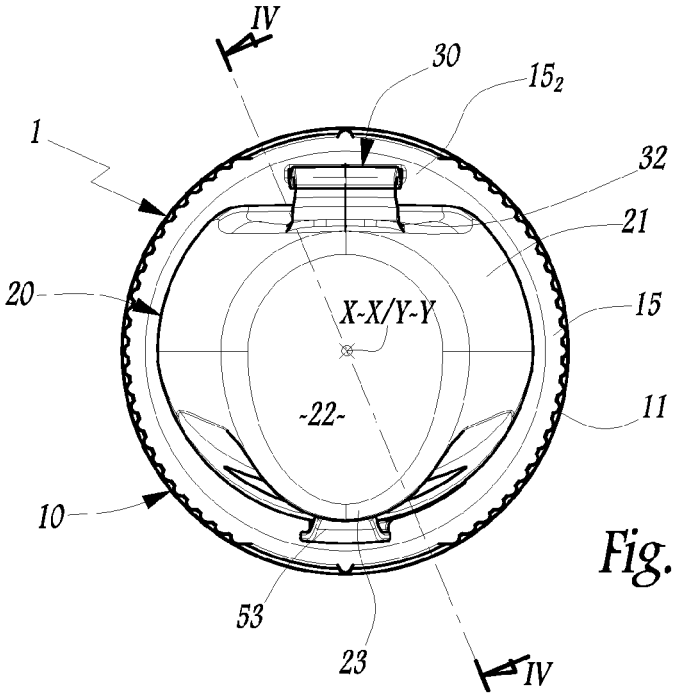

In the embodiment considered in the figures, the cap 20 is advantageously permanently connected to the base 10 by a strap 30 which, by flexible deformation, allows the reversible movement of the cap 20 between the closed and open positions thereof. Particularly advantageously, this strap 30 is designed to guide the movement of the cap 20 between its closed and open positions globally pivotably, in particular substantially around a geometric axis that extends in a direction orthoradial to the axes X-X and Y-Y. Along the periphery of the base 10, this strap 30 and, consequently, the aforementioned geometric axis or, more generally, the region around which or from which the cap 20 tilts between the closed and open positions thereof, while being guided by the strap 30, are situated in a portion considered to be behind the base 10, in the sense that said peripheral portion of the base is opposite the user handling the stopper device 1. In this context, it will be understood that the cap 20 is advantageously provided with a front tab 23, which extends in the plane of the bottom wall 22 and overhangs a depression 24 formed in the front peripheral portion of the body 21: in this way, a user can place one of his fingers in the depression 24 and press it against the surface of the tab 23, turned toward the depression, so as to apply a force F which, as shown in FIGS. 2 to 4, is oriented opposite the neck of the container 2 and in a direction substantially parallel to the axis Y-Y to pivot the cap 20. More generally, it will be noted that, even in the absence of the strap 30 or the presence of a strap not providing true guiding of the movement of the cap between the closed and open positions, applying the aforementioned force F, if applicable using the tab 23 and the depression 24, has the interest of guiding the movement of the cap substantially in the direction of the axis X-X and opposite the neck of the container 2 when, while the ring 10 is fastened to the neck of the container, the cap leaves its closed position to return to its open position.

As shown in FIGS. 2, 5 and 6, references 31 and 32 designate the two opposite ends of the strap 30: the end 31 is connected to a rear peripheral portion of the base 10, while the end 32 is connected to a rear peripheral portion of the cap 20, more specifically the body 21 of said cap. Advantageously, as shown in FIGS. 3 and 6, the end 31 of the strap 30 is connected to a rear peripheral portion $\mathbf{15}_2$ of the annular wall 15, without interfering with the outer periphery of said annular wall. To that end, the rear portion $\mathbf{15}_2$ of the wall 15 has an increased radial dimension, compared to the rest of the annular wall 15, due to a truncation at the rear of the tubular shape of the nipple 14: in fact, as shown in FIGS. 5 and 6, the nipple 14 has a rear flat section $\mathbf{14}_1$ which, by connecting to the rear portion $\mathbf{15}_2$ of the annular wall 15, makes it possible to position the end 31 of the strap 30 at a radial distance from the axis X-X smaller than or equal to the maximum outer diameter of the rest of the nipple 14. In this way, while having a strap 30 present, the zone connecting the annular wall 15 to the body 11 of the base 10 in a stepped manner runs continuously over the entire periphery of the base: this stepped peripheral area makes it possible to press a tool there, not angularly indexed, for manipulating the stopper device 1, such as a screwing one, without being bothered by the presence of the strap 30. Using such a non-angularly indexed tool is cost-effective, facilitates manipulation of the stopper device, and makes it possible to increase the placement rhythms of the device 1 on the neck of the container 2, having noted that, advantageously, such a non-angularly indexed tool can successively be used, on a same bottling line, to place the stopper devices 1, then other compatible conventional stopper devices, for example flat stoppers.

While advantageously taking the preceding into account, the strap 30 is preferably made with the greatest possible width, i.e. the greatest possible dimension in a direction substantially orthoradial to the axes X-X and Y-Y. In particular, the strap 30 is preferably made in the form of a single body. In this way, the strap 30 has great resistance to breaking by torsion, i.e. when it is twisted on itself, in particular by rotating the cap 20 around itself so as to impose a globally spiral shape on the strap 30.

Independently or as a complement to the preceding considerations relative to the strap 30, said strap is advantageously made from so-called organoleptic quality polyethylene, i.e. a polyethylene whereof the majority of the components capable of altering the taste or odor of a liquid in contact therewith have been purified. One interest of this material is related to its plastic deformation capacity, which makes it possible on the one hand to still further strengthen the resistance to breaking, and, on the other hand, to immobilize, substantially without resilient return, the cap 20 in any intermediate position between the closed and open positions thereof, in return for a corresponding deformation of the strap 30. In this way, without causing plastic overstress and without running the risk of irreparably damaging the straps 30, the user can move the cap 20 away from the base 10 with as great a pivot amplitude as desired.

Also independently or as a complement to the preceding considerations relative to the strap 30, said strap advantageously has, between the ends 31 and 32 thereof, a substantially constant thickness, except in a thinner transverse line 33, situated closer to the cap 20 than the base 10. In light of its smaller thickness relative to the rest of the strap 30, the line 33 forms a preferred relative pivot axis between the base 10 and the cap 20 when said cap is moved between the closed and open positions thereof. This arrangement is particularly interesting when the cap 20 is moved from the open position to the closed position thereof, as shown successively in FIGS. 7 to 9: in fact, when the cap leaves its open position, the preferred pivoting thereof around the line 33 causes the end of the body 21, opposite the bottom wall 22, to follow a predetermined path centered on the axis formed by said line, guiding the rear portion of the aforementioned end until it interferes with the rear portion, here the rear flat section $\mathbf{14}_1$, of the nipple 14, against which the aforementioned end of the body 21 can then slide toward the annular wall 15 as the cap 20 is moved to its closed position. The risk is thereby limited that, at the beginning of driving of the cap from its open position, the aforementioned end of the body 21 will be axially folded against the upper surface of the bottom wall 16 of the nipple 14, which would prevent the proper progression of the rest of the pivoting movement of the cap to the closed position thereof.

Also independently or as a complement to the preceding considerations relative to the strap 30, said strap is advantageously integral with both the base 10 and cap 20. If applicable, the base 10, the cap 20 and the strap 30 are then, as in the embodiment illustrated in the figures, made in a single piece of plastic material, in particular polyethylene of organoleptic quality. In that case, in particular in order to facilitate molding of said piece in a single unit by plastic injection, the stopper device 1 advantageously has at least one plastic injection tunnel 14, which, in the embodiment considered in the figures and as shown in FIGS. 2 and 6, successively extends:

between the axial ends of the nipple 16, protruding towards the inside of the nipple, in the form of a tunnel portion 41 indicated in broken lines in FIG. 6, between the inner and outer peripheral ends of the rear portion $\mathbf{15}_2$ of the annular wall 15, protruding toward the outside of the base 10, in the form of a tunnel portion 42, indicated in broken lines in FIG. 6 and visible in FIG. 2, and between the opposite ends 31 and 32 of the strap 30, while being distributed over the entire length thereof.

In practice, the stopper device 1, thus made in a single piece, is obtained upon leaving the mold as in FIGS. 5 and 6, i.e. with the cap 20 in the open position.

The stopper device 1 also comprises, as tamper-evident means, a strand of material 50 and a hook 60.

In an unaltered configuration, i.e. in an original configuration corresponding to the fact that the tamper-evident means of the device 1 have not been stressed to open the device for the first time, in particular in a configuration upon leaving the mold, the strand 50 is connected to the cap 20 extending lengthwise along the periphery of the body 21 of the cap, in particular in the axial portion of said body 21 turned opposite the bottom wall 22. Thus, in the embodiment considered in the figures, the front portion of the body 21 of the cap 20 is therefore radially open all the way through, i.e. said front portion delimits a through window 25 whereof the edge turned opposite the bottom wall 22, which extends along the peripheral direction of the body 21, is made up of the strand 50. For reasons that will appear later, the strand 50 has a longitudinal end 51 frangibly connected to the body 21 of the cap 20, while preferably being situated diametrically opposite the end 32 of the strap 30, as shown in FIGS. 2 and 6. Opposite the end 51, the strand 50 has a longitudinal end 52 that is connected to the body 21 of the cap 20 non-frangibly, for plastic deformation purposes, as explained in more detail hereafter. Advantageously, the strand 50 and the cap 20 are made in a single piece, in particular by molding, the ends 51 and 52 then being integral with the body 21.

Figure 10:
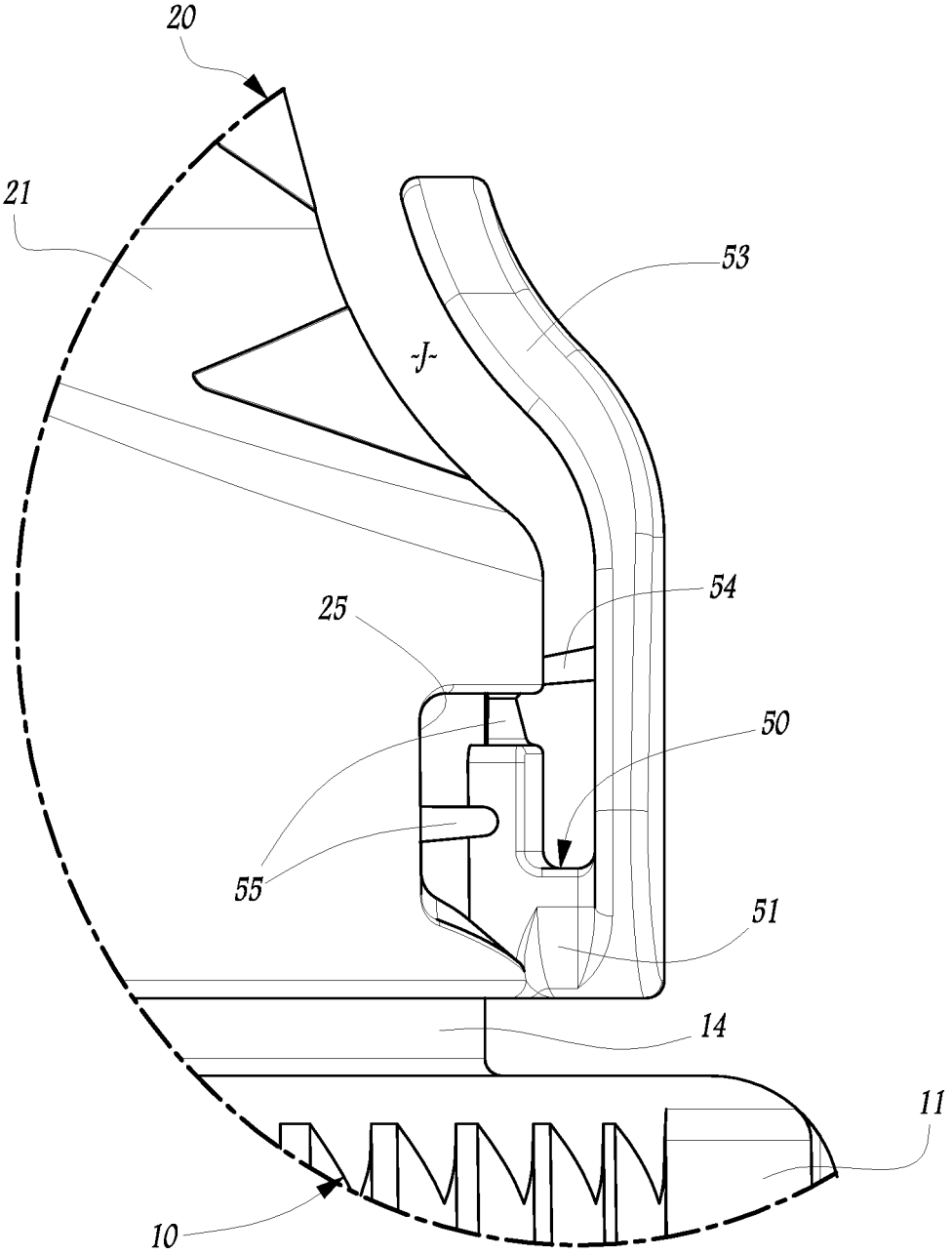
FIGS. 10 and 11 are larger-scale views of circled areas X in FIG. 2 and XI in FIG. 4, respectively.

As shown in FIGS. 2 and 10, the end 51 of the strand 50 is securely provided with a tab 53 protruding from the rest of the end 51, in particular so as to be easily grasped by the user. Thus, in the embodiment considered in the figures, the tab 53 extends from the rest of the strand 50 toward the bottom wall 22, essentially following a direction parallel to the axis Y-Y. In the unaltered configuration of the strand 50, the tab 53 partially covers the outer surface of the front portion of the body 21 of the cap 20, while allowing a play J to remain between them intended to facilitate grasping of the tab 53 by the user's fingers. In particular, in the embodiment considered in the figures, the free axial end of the 53 hugs, with insertion of the play J, a portion of the front depression 24 of the body 21, as shown in FIG. 10. In this way, the risks are limited of the free end of the tab 53 being inopportunely caught during manipulations of the device 1 before the first time it is opened by a user, whereas, conversely, to grasp the tab 53, the user is forced to engage the end of one of his fingers in the depression 24, so as to interfere with the free end of the tab 53. Of course, more generally, the tab 53 may assume various forms, without being limited to that shown in the figures, inasmuch as the selected form allows the user to grasp the tab manually and pull it toward him so as, inter alia, to break the frangible connection between the end 51 of the strand 50 and the body 21 of the cap 20.

In practice, the aforementioned frangible connection is made by at least one frangible bridge inserted between the cap 20 and the end 51 of the strand 50. Thus, in the embodiment considered in the figures, such bridges are provided, referenced 54 and 55, as shown in FIG. 10: more specifically, the bridge 54 directly connects the tab 53 to the body 21 of the cap 20, while the two bridges 55 directly connect the rest of the end 51 to the body 21 of the cap 20. Of course, the number and arrangement of the frangible bridge(s) are not limited to those considered in the figures, as long as at least one such bridge connects the end 51 of the strand 50 and the cap 20, if applicable via the tab 53.

As one alternative not illustrated, as a replacement and/or complement to all or some of the bridges 54 and 55, a thin tearable membrane can be provided as frangible connection between the cap 20 and the end 51 of the strand 50.

The hook 60 assumes the form of a relief protruding from the outer surface of the front portion of the nipple 14, at the lower portion of the latter part. In the embodiment considered here, this hook 60 is thus integral with the nipple 14, which facilitates the manufacture thereof by molding in a single piece with the base 10.

The hook 60 is sized so as to be received in the window 25 when the strand 50 is in the unaltered configuration thereof and the cap 20 is in the closed position. In this way, the hook 60 has an elongate shape, which extends along the outer periphery of the nipple 14.

Along the periphery of the nipple 14, the hook 60 advantageously has a dimension smaller than the dimension, along the periphery of the body 21 of the cap 20, of the window 25: more specifically, as shown in FIGS. 1 and 5, the hook 60 does not run, along the periphery of the nipple 14, at a point diametrically opposite the end 31 of the strap 30, that is arranged so as to be slightly angularly offset. This amounts to saying that, diametrically opposite the end 31 of the strap 30, the nipple 14 does not have a local increase in the outer diameter thereof, related to the presence of the hook 60. The interest of this arrangement will appear later. Thus, along the outer periphery of the nipple 14, the end 61 of the hook 60, which is situated closest to the anteroposterior diametrical plane passing through the end 31 of the strap 30, is not situated in the aforementioned diametrically, but is arranged facing it, in the directions of axes X-X and Y-Y, of the running portion 56 of the strand 50. The opposite peripheral end 62 of the hook 60 is advantageously situated in the peripheral bottom of the window 25, i.e. substantially axially facing the end 52 of the strand 50.

Figure 11:
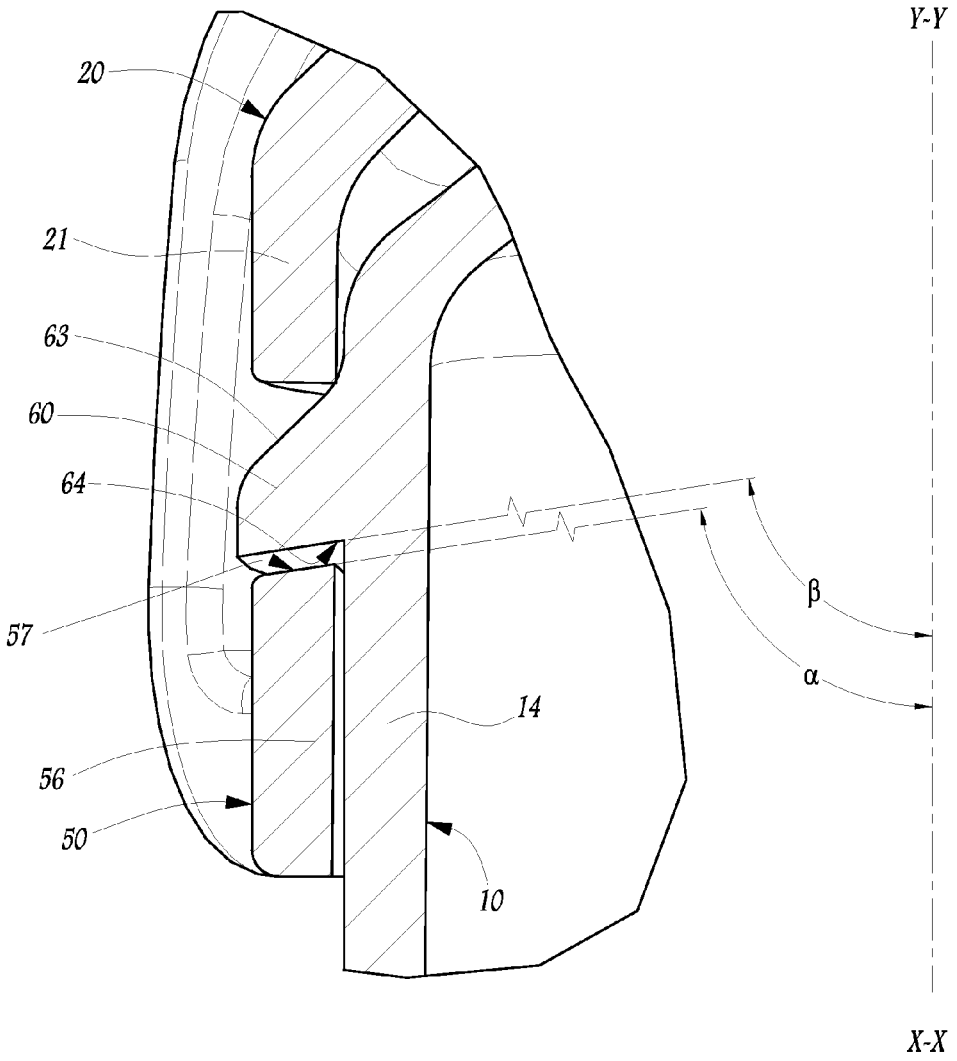

In the direction of the axis X-X, the hook 60 has a dimension substantially equal to the dimension, along the axis Y-Y, of the window 25, as shown in FIG. 11. Advantageously, the hook 60 has an upper surface 63 which, moving away from the outer surface of the nipple 14, is inclined downwardly and, opposite it, a lower surface 64 which, moving away from the outer surface of the nipple, is also downwardly inclined. When the strand 50 is in the unaltered configuration thereof and the cap 20 is in the closed position, as in FIGS. 1 to 4, 10 and 11, the lower surface 64 of the hook 60 is directly opposite, in the direction of the axes X-X and Y-Y, an axial end surface 57 delimited by the running portion 56 of the strand 50, as shown in FIG. 11. Advantageously, for reasons that will appear later, this surface 57 of the strand 50 is complementary to the lower surface 64 of the hook 60.

To manufacture the stopper device 1, the base 10, the cap 20, the strap 30, the strand 50 and the hook 60 are advantageously obtained in a single piece by molding a plastic material, in particular a polyethylene said to be of organoleptic quality, as mentioned above. In particular, upon leaving the mold, the stopper device 1 has the configuration of FIGS. 5 and 6, i.e. with the strand 50 in the unaltered configuration thereof and the cap 20 in the open position. Before or after the ring 10 is fastened around the neck of the container 2, the cap 20 is moved from its open position to its closed position, to result in the configuration shown in FIGS. 1 to 4, 10 and 11: to that end, as explained above, in particular in light of FIGS. 7 to 9, the strap 30 advantageously guides the closing movement of the cap 20. Additionally, when the cap 20 is on the verge of reaching its closed position, the strand 50 crosses the hook 60, from top to bottom, without being damaged, i.e. while preserving the integrity of its unaltered configuration: to that end, the upper surface 63 of the hook 60 advantageously forms a ramp against which the running portion 56 of the strand 50 progressively slides, while elastically stressing said running portion 56 outwardly, until said running portion is located below the level of the lower surface 64 of the hook 60, the running portion 56 of the strand 50 then being positioned naturally just below said surface 64, by elastic return of the material making up the strand 50. It will be understood why it is of interest for the end 61 of the hook 60 not to occupy, around the axis X-X, the same angular position as it, around the axis Y-Y, as the end 51 of the strand 50, but for said end 61 of the hook 60 to be angularly offset: in this way, when the strand 50 crosses the hook 60, the end 51 of the strand is stressed very little or not at all, since it does not have to cross an element with a radial overthickness on the outer surface of the front portion of the nipple 14, contrary to the rest of the strand 50 having to cross the hook 60. In this way, the frangible connection between the end 51 of the strand 50 and the body 21 of the cap 20 is preserved, while significantly limiting the risk of the frangible bridges 54 and 55 being inopportunely broken during the initial closing of the cap 20.

The stopper device 1 is used as follows. Initially, it is considered that the neck of the container 2 is closed by the device 1, which has not yet been opened for the first time, as shown in FIGS. 1 to 4, 10 and 11. A user wishing to open the device 1 may then be tempted to move the cap 20 from the current closed position to the open position thereof, in particular by pivoting guided by the strap 30, by applying a force F on the tab 23: however, in that case, the cap 20 is prevented from leaving the closed position thereof by the blocking cooperation between the lower surface 64 of the hook 60 and the surface 57 of the strand 50. In fact, as shown in FIG. 11, this attempt by the user leads to pressing the surface 57 of the running portion 56 of the strand 50 axially upward against the surface 64 of the hook 60, said surface 64 then forming a stop immobilizing the strand 50 and, thus the entire cap 20. This blocking effect is advantageously reinforced by the relative configuration of the surfaces 57 and 64: in fact, given the downward incline of one and/or the other of these surfaces 57 and 64 when the latter are traveled moving away from the axes X-X and Y-Y, their placement in contact in the direction of the axes X-X and Y-Y guides and presses the running portion 56 of the strand 50 against the stepped zone of the nipple 14, connecting the surface 64 to the outer surface of the front portion of the nipple 14. According to one preferred embodiment, shown in FIG. 11, the immobilization effect of the cap 20, by guiding then pressing the strand 50 against the aforementioned stepped zone of the nipple 14, is obtained by providing that one and/or the other of the surfaces 57 and 64 have, in an axial cutting plane, a substantially rectilinear profile which, on the side turned toward the neck of the container 2, forms, with the axis Y-Y and the axis X-X, respectively, an angle α and β, respectively, which is strictly smaller than 90°.

After having observed the impossibility of moving the cap 20 from the closed position thereof, or spontaneously, the user naturally acts on the tab 53: more specifically, the user manually grasps said tab 53, while being assisted by the presence of a residual play J radially present between the tab 53 and the outer surface of the nipple 14. Once the user has begun to pull the tab 53 toward him, he concomitantly drives the rest of the first end 51 of the strand 50, thereby causing the rupture of the frangible bridges 54 and 55. In the continuation of his movement, the user progressively moves the entire running portion 56 of the strand 50 radially away toward the outside of the cap 20, as indicated by arrow E in FIG. 12, thereby progressively disengaging the surfaces 57 and 64 relative to one another. The stopper device 1 is then in the configuration shown in FIG. 12. In practice, the running portion 56 of the strand 50 then does not oppose any resistance against being moved outwardly, while the majority of the corresponding forces are concentrated in the connecting zone between the end 52 of the strand 50 and the body 21 of the cap 20: this connecting zone then deforms plastically, thereby guaranteeing good visibility of the altered configuration of the strand 50, since the latter does not tend to return to its initial configuration by elastic return.

The driving of the end 51 of the strand 50 is thus continued by the user until the surfaces 57 and 64 are completely disengaged from one another. Advantageously, to reinforce the outwardly protruding arrangement of the strand 50 in its configuration thus altered, this driving of the end 51 is thus to be done over at least 45°, or even 90° around a geometric axis substantially parallel to the axis X-X and passing through the end 52 of the strand 50.

The user can then drive the cap 20 from the closed position toward the open position thereof, without the strand 50 causing blocking of the movement of the cap, since its running portion 56 of the strand is then no longer axially upwardly retained by the hook 60. When the cap 20 is thus moved to its open position, the stopper device 21 reaches the configuration shown in FIG. 13.

Figure 14:
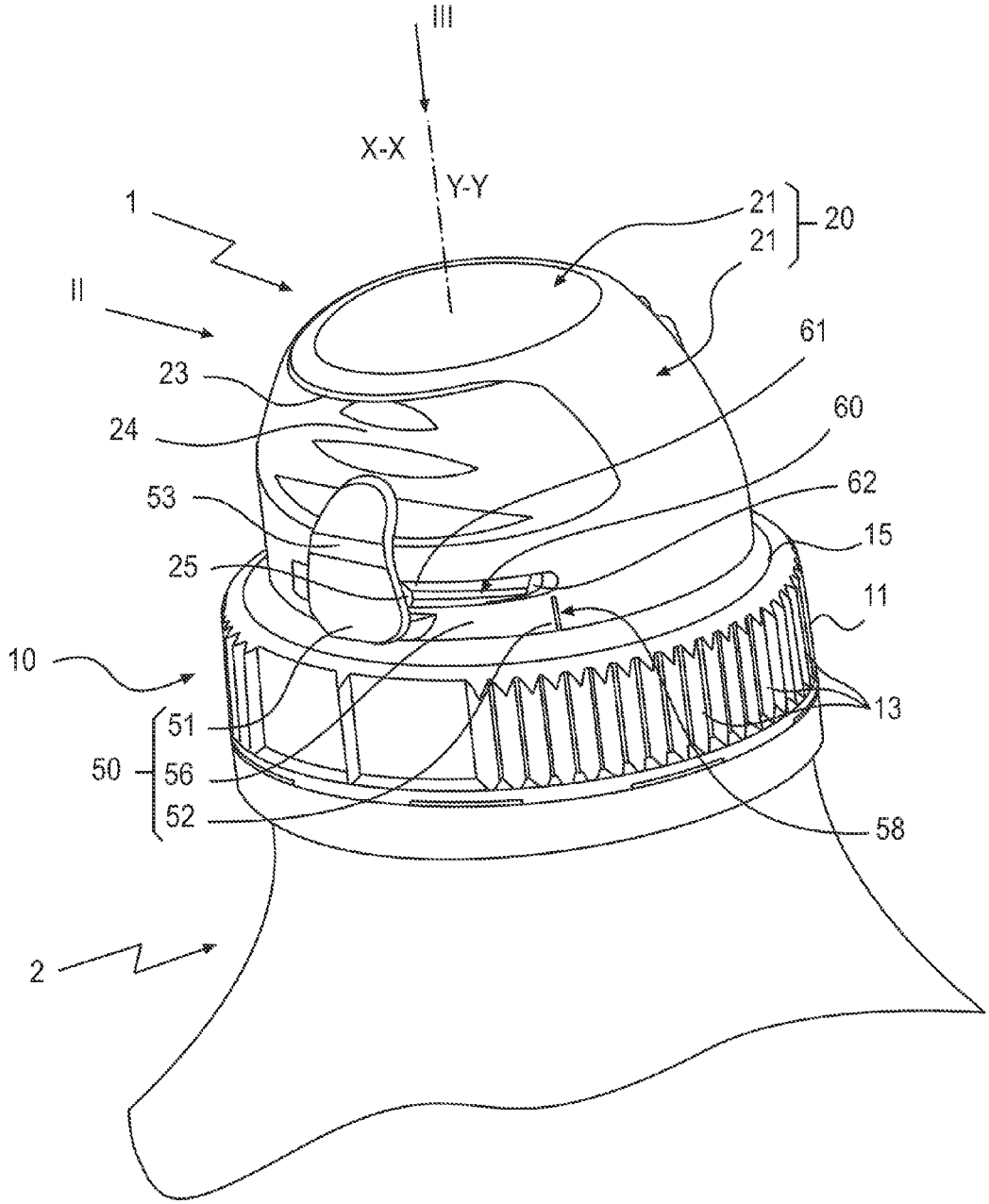
FIG. 14 is a perspective view of an alternative stopper device according to the invention, assembled to the neck of a container and not yet having been opened for the first time.

Various arrangements and alternatives to the stopper device 1 described until now also be considered. For example:

In the example considered until now, the strand 50 and the hook 60 are positioned globally at the front of the base 10 and the cap 20, in particular for good visibility by the user; alternatively, this strand and this hook can be provided in other peripheral portions of the device 1, in particular on one of the lateral sides of the base and the cap, in particularly globally at 90° around the axes X-X and Y-Y relative to the tab 23; likewise, several strand/hook pairs can be provided, for example one on each lateral side of the device;

Rather than being secured around the neck 2 by screwing, the ring 10 can be secured by snapping, i.e. by snapping a portion of the inner surface thereof with a complementary portion of the neck;

The use of a strand and a hook, respectively similar to the strand 50 and the hook 60, can be considered for stopper devices other than those with a pivoting cap, in particular via a thin guide strap such as the strap 30, like the cap 20, once the cap of these devices is to be moved from the base upward, in the direction opposite the neck of the container 2, when, at least first time it is opened, it leaves its closed position to move to its open position;

Rather than producing the stopper device 1 in a single piece, the latter may be obtained by assembling at least two distinct pieces; and/or Rather than providing that the end 52 of the strand 50 is permanently connected to the cap 20, said end may, as one alternative shown in FIG. 14, integrate a rupturing element 58 designed, first, not to rupture when the strand goes from the unaltered configuration to the altered configuration thereof, then, only secondly, to be manually broken by the user so as to separate the strand from the cap 20.

The invention claimed is:

1. A stopper device for the neck of a container, including:

a base which is tubular and adapted to be fastened to a neck of a container, a cap which is tubular and repeatedly movable relative to the base between a closed position, in which the cap sealably covers the opening of the base, while covering the base at least partially, and an open position, in which the cap is remote from the base to allow a flow through the opening of the base, said cap being moved substantially in the direction of the axis of the base and opposite the neck of the container when the cap moves from the closed position to the open position, and tamper-evident means configured to provide a visual indication of whether the cap has previously moved from the closed position to the open position, said tamper-evident means including a strand which, in an unaltered configuration, extends lengthwise along the periphery of the cap, and a hook element, which is secured integral with the base, protruding toward the outside of the base, wherein the hook element is adapted so that, when the strand is in the unaltered configuration thereof, the hook element retains a longitudinal portion of the strand, in a direction substantially parallel to the axis of the base, so as to block the movement of the cap from the closed position to the open position, and in that a first longitudinal end of the strand is frangibly connected to the cap and is integrally provided with a tab for manually driving the strand so as to detach the first end of the strand relative to the cap, by breaking the frangible connection between them, then to move the longitudinal portion of the strand away toward the outside of the cap, by plastic deformation of a non-frangible connection between a second longitudinal end of the strand and the cap, until the strand reaches an altered configuration in which the cap is free to be moved from the open position to the closed position and from the closed position to the open position without the longitudinal portion of the strand being retained by the hook element, wherein the second end of the strand is provided with a rupturing member configured to not break when the strand has gone from the unaltered configuration to the altered configuration of the strand, and the rupturing member configured to be manually broken so as to separate the strand from the cap after the strand has reached the altered configuration.

2. The device according to claim 1, wherein the frangible connection between the first end of the strand and the cap includes at least one frangible bridge connecting the cap to the tab of said first end and/or at least one frangible bridge connecting the cap to the rest of said first end.

3. The device according to claim 1, wherein when the strand is in the unaltered configuration, at least part of the tab of the first end of the strand protrudes from the rest of said first end in a direction substantially parallel to the axis of the cap, and partially covers the outer surface of the cap.

4. The device according to claim 1, wherein when the strand is in the unaltered configuration and the cap is in the closed position, the longitudinal portion of the strand delimits a bearing surface which, in the direction of the axis of the base, is facing a stop surface delimited by the hook element.

5. The device according to claim 4, wherein the bearing surface and the stop surface are configured to cooperate with one another by contact, as long as strand is in the unaltered configuration, to press the longitudinal portion of the strand against a stepped area of the ring connecting the stop surface to the outer surface of the base, when the cap is moved from the closed position to the open position.

6. The device according to claim 5, wherein at least one of the bearing surface or the stop surface have, in an axial plane, a substantially rectilinear profile which, on a side turned toward the neck of the container, forms, respectively with the axis of the base, an angle smaller than 90°.

7. The device according to claim 1, wherein when the strand is in the unaltered configuration and the cap is in the closed position, the hook element has, along the periphery of the base, an end that is substantially axially opposite the second end of the strand, while the opposite end of the hook element is axially across from the longitudinal portion of the strand.

8. The device according to claim 1, wherein the device also includes a strap that permanently connects the base and the cap and guides the movement of the cap between the closed and open positions, and wherein the strap is configured to pivot around a geometric axis substantially orthoradial to the axis of the base.

9. The device according to claim 8, wherein when the strand is in the unaltered configuration, the first end of the strand is situated, along the periphery of the cap, diametrically opposite the end of the strap, connected to the cap.

10. The device according to claim 8, wherein the strap has, between the opposite ends thereof respectively connected to the base and the cap, a substantially constant thickness, except in a thinner transverse line, which is situated closer to the cap than the base and which forms a relative pivot axis between the base and the cap.

11. The device according to claim 8, wherein the base includes a tubular main body, adapted to be secured around the neck of the container, and a flow nipple that is arranged coaxially to the main body and that is connected to said main body by an annular wall connecting the inner surface of the main body to the outer surface of the nipple, and in that the nipple has an outer flat portion at the peripheral level of which the end of the strap is arranged, connected to the base, without interfering with the outer periphery of the annular wall so as to form a stepped area, connecting the annular wall to the main body, which runs continuously over the outer periphery of the base.

12. The device according to claim 1, wherein the base, the cap, the strand and the hook element are made in a single piece molded from a plastic material.

13. The device according to claim 11, wherein the device has a plastic injection tunnel, which extends successively:

between the axial ends of the nipple, protruding toward the inside of the nipple, between the inner and outer peripheral ends of the annular wall, protruding toward the outside of the base, and between the opposite ends of the strap.

14. The device according to claim 12, wherein the strap is made in a single piece molded from the plastic material.

15. The device according to claim 14, wherein the plastic material is polyethylene of organoleptic quality.

* * * * *